US005819612A

United States Patent [19]

Anderson

[11] Patent Number: 5,819,612

[45] Date of Patent: Oct. 13, 1998

[54] MULTIPLE BIT STORING HAND TOOL HAVING MINIMIZED BULK VOLUME AND HIGH STORAGE CAPACITY

[76] Inventor: Wayne Anderson, 65 Grove St., Northport, N.Y. 11768

[21] Appl. No.: 960,090

[22] Filed: Oct. 24, 1997

Related U.S. Application Data

[63] Continuation of Ser. No. 608,195, Feb. 28, 1996, abandoned.

[51] Int. Cl.[6] ..... B25G 1/08

[52] U.S. Cl. ..... 81/490; 81/177.4; 81/439

[58] Field of Search ..... 81/177.1, 177.4, 81/438, 439, 489, 490, 492

[56] References Cited

U.S. PATENT DOCUMENTS

| | | | |
|---|---|---|---|
| 707,901 | 8/1902 | Cheney | 81/490 |
| 3,426,813 | 2/1969 | Robertson | 81/490 |
| 4,096,896 | 6/1978 | Engel | 81/177.4 X |
| 4,846,042 | 7/1989 | Wetty | 81/490 |
| 4,924,733 | 5/1990 | McKenzie | 81/490 X |
| 4,969,231 | 11/1990 | Mader et al. | 81/177.1 X |
| 5,499,562 | 3/1996 | Feng | 81/177.4 |

*Primary Examiner*—James G. Smith

*Attorney, Agent, or Firm*—Lackenbach Siegel Marzullo Aronson & Greenspan, PC

[57] ABSTRACT

An ergonomic, improved multiple bit storing hand tool that provides storage capacity for a large number of bits while minimizing bulk material volume and hand gripping member cross sectional area so as to provide for increased gripping ability. The improved multiple bit storing hand tool includes a non-cylindrical, elongated, hand gripping portion having corners and a central axis substantially parallel to a plurality of substantially parallel corner axes of the corners. In a variant, the corner axes are generally lobular and include epicycloidal portions thereof. Each of the substantially parallel corner axes are substantially equidistant from the central axis and substantially equidistant one from another. A plurality of elongated storage compartments having compartment axes are substantially parallel to the parallel corner axes and the central axis. A plurality of the elongated storage compartment axes are substantially disposed at a point on an imaginary line connecting the central axis and each of the parallel corner axes. The number of bits stored within the multiple bit storing hand tool is maximized while the elongated hand gripping portion of the hand tool is minimized in bulk volume and weight as compared to a conventional tool having a cylindrical hand gripping portion.

28 Claims, 3 Drawing Sheets

100
102
104
106
108
110
112
116
118
120
128
130
132
136
140
142
144
146
148
D
D'

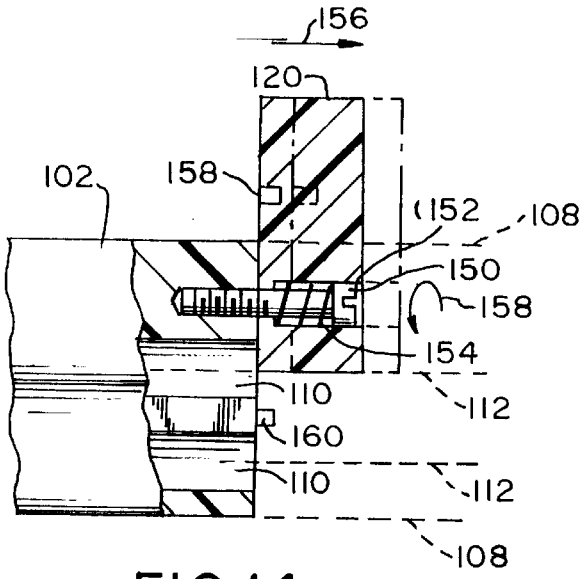
FIG.14
FIG.9
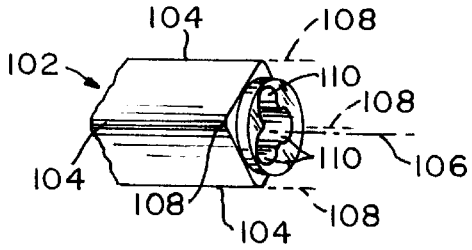
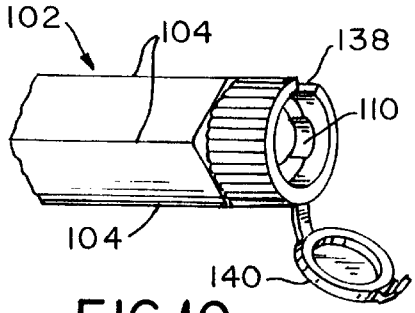
FIG.10
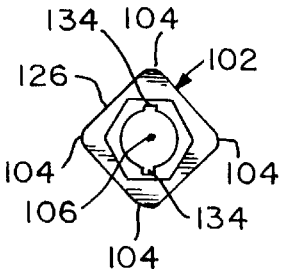
FIG.12
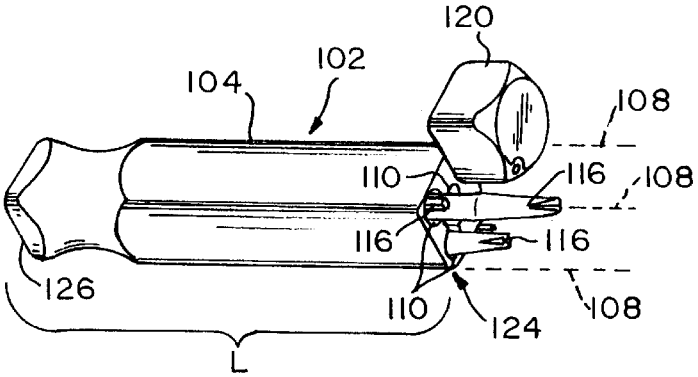
FIG.11
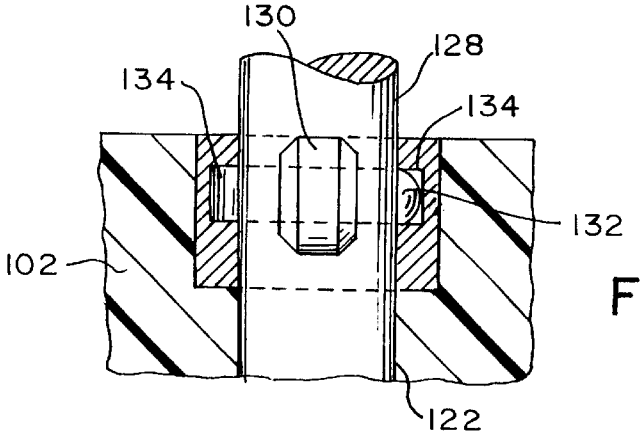
FIG.13

MULTIPLE BIT STORING HAND TOOL HAVING MINIMIZED BULK VOLUME AND HIGH STORAGE CAPACITY

This application is a continuation of application Ser. No. 08/608,195, filed Feb. 28, 1996, abandoned.

BACKGROUND OF THE INVENTION

This invention relates to hand tools; and, more particularly, it relates to multiple bit storing hand tools that provide improved ergonomic gripping ability, minimize bulk marterial volume in the hand gripping portion of the hand tool, and store a large number of interchangeable bits in the hand gripping and driving portion of the hand tools. The recent increase in the number of specialty tools required for work around automobiles and in industry in general has severely decreased the available amount of storage space for traditional tools and accessories therefor. The resultant decrease in the amount of available storage space has increased the need for the efficient use of space both within a respective tool while maintaining the ergonomics of the tool, and for the efficient use of space in large tool boxes through the utilization of multi-purpose and multi-function traditional and specialty hand tools.

All of these developments have created a need for a variety of hand tools having decreased bulk volume and maximized storage capacity. However, this need has not been easily achieved. Traditional hand tools with cylindrical or spherical storage compartments are large, bulky and difficult to grasp and turn. In contradistinction, hand tools that are ergonomic lack the requisite storage capacity so that multiple tools are needed to perform multiple tasks. Tool storage spaces hence overflow with similar tools having different driver bit portions. Hence, there exists a need for a hand tool and kit that can store, organize and retain a large number of desired tool accessories within the tool itself, and that functions as a multiplicity of different tools while displacing no more volume than a conventional single purpose hand tool.

There are numerous tools in the art that fail to meet these market needs and that suffer from a number of drawbacks. In particular, attention is drawn to U.S. Pat. No. 19,901 to Aiken, U.S. Pat. No. 438,150 to Glover, U.S. Pat. No. 463,507 to Goodell, U.S. Pat. No. 686,424 to Smith, U.S. Pat. No. 2,158,728 to Peters, U.S. Pat. No. 2,476,762 to Petre et al., U.S. Pat. No. 2,527,492 to Cleary et al., U.S. Pat. No. 2,596,594 to Petre et al., U.S. Pat. No. 2,635,661 to Egan et al., U.S. Pat. No. 2,759,734 to Velepec et al., U.S. Pat. No. 3,114,401 to Johnson et al., U.S. Pat. No. 3,426,813 to Robertson, U.S. Pat. No. 3,455,355 to McLogan et al., U.S. Pat. No. 4,043,230 to Scrivens et al., U.S. Pat. No. 4,278,119 to Elmore et al., U.S. Pat. No. 4,404,874 to Lieser et al., U.S. Pat. No. 4,448,097 to Rocca et al., U.S. Pat. No. 4,552,043 to Corona et al., U.S. Pat. No. 4,776,246 to Elliston, U.S. Pat. No. 4,779,493 to White, U.S. Pat. No. 4,846,042 to Wetty, U.S. Pat. No. 4,924,733 to McKenzie, U.S. Pat. No. 5,174,178 to Disston, U.S. Pat. No. 5,228,363 to Corona et al., U.S. Pat. No. 5,265,504 to Fruhm, U.S. Pat. No. 5,325,745 to Koehler, U.S. Pat. No. 5,337,637 to Bih-Lien, and U.S. Pat. No. 5,450,775 to Kozak. All of these tools have the drawbacks associated with excessive bulk volume and excessive use of material used for producing the handle portions thereof for a given number of tool elements, as well as other limitations in the use thereof.

It is an object of the present invention to solve the variety of problems that exist in the art and to satisfy these market needs.

SUMMARY OF THE INVENTION

The present invention provides an improved multiple bit storing hand tool. The improved multiple bit storing hand tool includes a non-cylindrical, elongated, hand gripping portion having corners and a central axis substantially parallel to a plurality of substantially parallel corner axes of the corners. Each of the substantially parallel corner axes are substantially equidistant from the central axis and substantially equidistant one from another. A plurality of elongated storage compartments having compartment axes are substantially parallel to the parallel corner axes and the central axis. A plurality of the elongated storage compartment axes are substantially disposed at a point on an imaginary line connecting the central axis and each of the parallel corner axes. The number of bits stored within the multiple bit storing hand tool is maximized while the elongated hand gripping portion of the hand tool is minimized in bulk material volume and weight as compared to a conventional tool having a cylindrical or spherical hand gripping portion.

In another variant, the hand tool includes an epicycloidally shaped, elongated, hand gripping portion having a plurality of epicycloidal portions thereon. Each epicyclodial portion has at least one elongated storage compartment extending into the portion, and the elongated storage compartment has wall portions thereof being formed from portions of respective epicycloidal portions. A central coupling retaining cavity is also encircled by the elongated storage compartments and epicycloidal portions.

The objects and features of the present invention, other than those specifically set forth above, will become apparent in the detailed description of the invention set forth below.

BRIEF DESCRIPTION OF THE DRAWINGS

FIG. 9 is a partial perspective view of a variant of the hand gripping portion of FIG. 8 having a hand gripping portion substantially similar to that of FIG. 1 and including a top circular collar portion within which the storage compartments are juxtaposed to corner apexes of the hand gripping portion of FIG. 1;

FIG. 10 is a partial perspective view of the hand gripping portion of FIG. 9 further including a "snap on" cap portion;

FIG. 11 is a perspective view of the hand gripping portion of FIG. 1 having bits partially disposed within the storage compartments of the hand gripping portion;

FIG. 12 is a bottom plan view of the hand gripping portion of FIG. 1 having a coupling engaging portion free of the coupling member of FIG. 1;

FIG. 13 is a side cross sectional view of the hand gripping portion of FIG. 1 in which the coupling member engages the hand gripping portion;

FIG. 14 is a partially exposed side cross sectional view of the hand gripping portion of FIG. 1 illustrating the rotation of the cap of FIG. 1;

DETAILED DESCRIPTION OF THE INVENTION

Figures 1, 2, 3, 4, 5, 6, 7, 8:
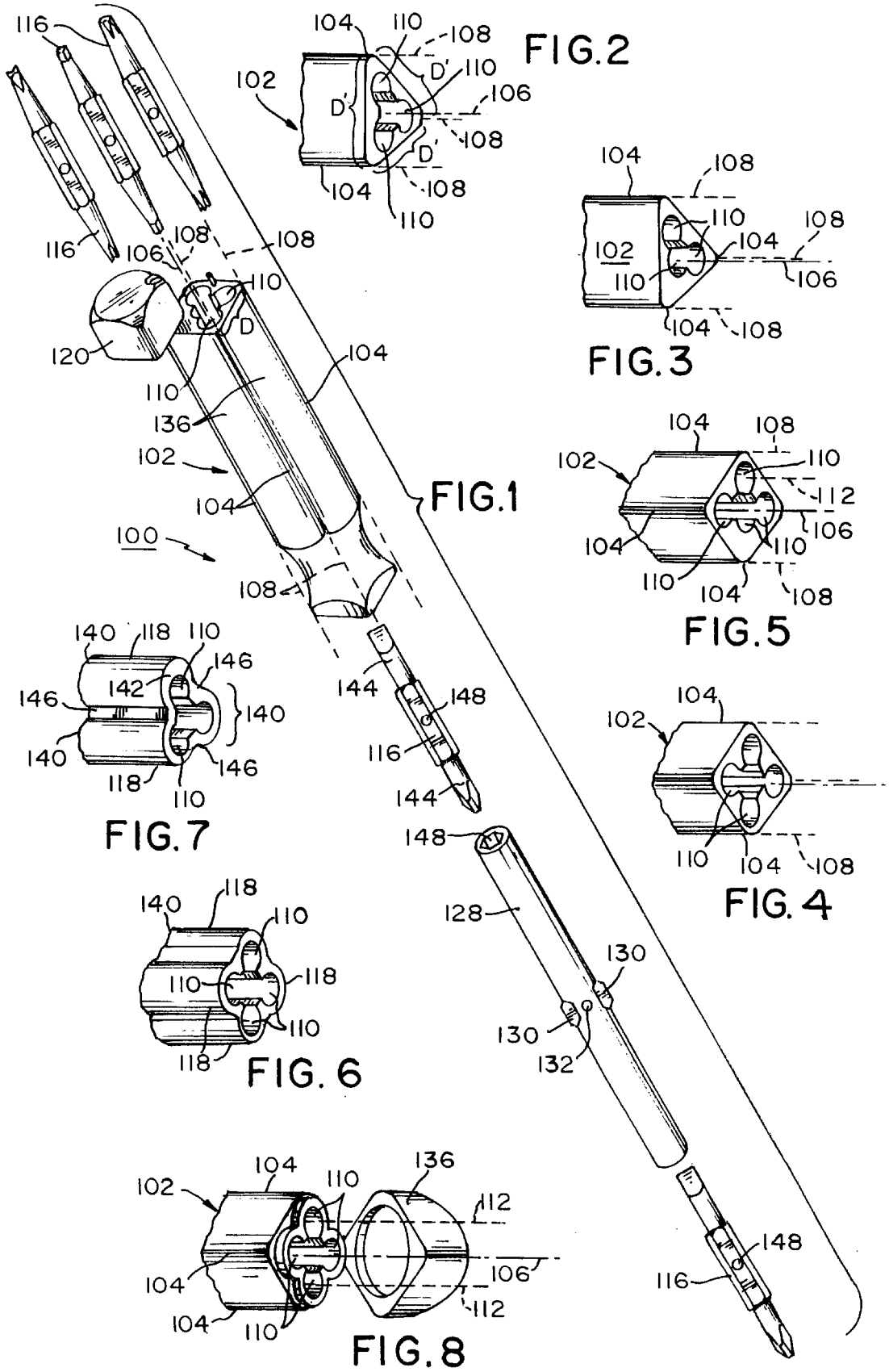
FIG. 1 is an exploded perspective view of an improved ergonomci multiple bit storing hand tool having minimized bulk volume and high storage capacity.
FIG. 2 is a partial perspective view of a variant of the hand gripping portion of the improved multiple bit storing hand tool of FIG. 1 in which the hand gripping portion is generally triangular in shape and in which there is a triad of storage compartments.
FIG. 3 is a partial perspective view of a variant of the hand gripping portion of the improved multiple bit storing hand tool of FIG. 2 in which the hand gripping portion has two storage compartments.
FIG. 4 is a partial perspective view of a variant of the hand gripping portion of the improved multiple bit storing hand tool of FIG. 5 having four storage compartments.
FIG. 5 is a partial perspective view of the hand gripping portion of the improved multiple bit storing hand tool of FIG. 1 free of the cap of FIG. 1.
FIG. 6 is a partial perspective view of an exemplary epicycloidally shaped hand gripping portion having four epicycloids and four storage compartments.
FIG. 7 is a partial perspective view of an exemplary epicycloidally shaped hand gripping having three epicycloids and three storage compartments.
FIG. 8 is a partial perspective view of a variant of the hand gripping portion of FIG. 1 having a hand gripping portion substantially similar to that of FIG. 1 and including a top epicycloidally shaped portion and a "snap-on" cap.
Figure 15:
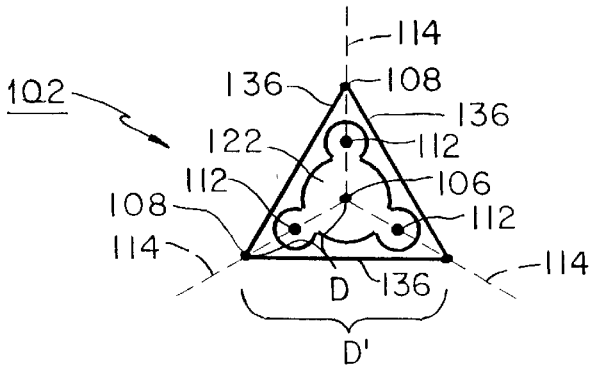
FIG. 15 is a top plan view of the hand gripping portion of FIG. 2.

FIG. 1 is an exploded perspective view of improved ergonomic multiple bit storing hand tool 100. Hand tool 100 includes a non-cylindrical, elongated, hand gripping portion 102 (FIGS. 1 and 11). As illustrated in the different variants in FIGS. 1–5, 8, 9, and 11–12, hand gripping portions 102 have corners 104 (FIGS. 1–5 and 9–12) and a central axis as indicated by imaginary line 106 (FIGS. 1–5 and 9) substantially parallel to a plurality of substantially parallel corner axes of corners 104 as indicated by imaginary lines 108 (FIGS. 1–5, 9, 11, 14 and 15). Each of the substantially parallel corner axes as indicated by imaginary lines 108 are substantially equidistant from the central axis as indicated by imaginary line 106 and separated therefrom by distance D (FIGS. 1, 3 and 15). Optionally, substantially parallel corner axes as indicated by imaginary lines 108 are substantially equidistant one from another as indicated by distance D' (FIGS. 2 and 15). A plurality of elongated storage compartments 110 (FIGS. 1–11 and 14) that have compartment axes as indicated by imaginary lines 112 (FIGS. 4, 5, 8 and 15) are substantially parallel to the parallel corner axes as indicated by imaginary lines 108 and the central axis as indicated by imaginary line 106.

As shown in the Figures, storage compartments 110 include a bore and have a circular cross section. It is generally understood that the cross section of the shape of storage compartments 110 also include triangular shapes positioned so that an angle of the triangular shape is juxtaposed to a respective corner 104. In yet a further embodiment, storage compartments 110 have a cross section that takes the shape of a square, rectangle or other 4 sided two dimensional planar figure positioned within the hand gripping portion and juxtaposed to corners 104 such that the bulk material volume of hand gripping portion 102 is minimized. Of course, the storage compartments 110 can also have a cross section that takes the shape of the two dimensional geometric figures consitent with the spirit of the invention. It is generally appreciated that the cross sectional area, e.g. that illustrated in FIG. 15, of hand gripping portion 102 is that of an equilateral triangle and is less than that of a circle having a radius extending from imaginary line 106 to imaginary line 108.

A plurality of elongated storage compartment axes 112 are substantially disposed at a point on imaginary lines 114 (FIG. 15) connecting central axis imaginary line 106 and each of the parallel corner axes imaginary lines 108. Preferably, hand tool 100 includes elongated storage compartments 110 that total at least the sum of corners 104, 118 less one. This number of storage compartments provides for a location on hand gripping portion 102 at which one can removably or pivotally connect cap 120 to hand gripping portion 102 (FIGS. 1, 11 and 14). The length L (FIG. 11) of elongated hand gripping portion 120 is at least the length of the average hand grip of an adult male and is generally in the range of 4–12 inches. It is possible, however, that length L can be in the range of 1–20 inches depending upon the application for which the hand tool 100 is utilized.

For ease of illustration FIG. 15 depicts imaginary lines 106, 108 and 112 as coming directly out of the plane formed by imaginary lines 114. That is, imaginary lines 106, 108 and 112 are substantially parallel one to another. Lines 106, 108 and 112 are substantially perpendicular to lines 114. Lines 114 project from the point of intersection of lines 114 with line 106 and generally lie in a common plane. Even though imaginary lines 112 are not illustrated in all Figures, it is understood that they are present therein.

It is appreciated that the number of bits 116 (FIGS. 1 and 11) stored within the multiple bit storing hand tool 100 is maximized with the geometric arrangement of the respective storage compartments 110, corner axes 104, and other components of the respective invention one to another. This geometric arrangement allows for the elongated hand gripping portion 102 to be minimized in bulk material volume and weight as compared to a conventional tool having a cylindrical hand gripping portion. It is further appreciated that hand gripping portion 102 is of a size and shape that is easily grasped by an adult male's hand while storing a large number of interchangeable bits 116 in the hand gripping portion and in coupling member 128.

A variant of the above geometric arrangement of the invention is illustrated in FIGS. 6–7. As illustrated in FIGS. 6 and 7, corners 104 are lobular such that they form lobular corners 118. Lobular corners 118 are formed along the entire hand gripping portion 102 in one variant. In another variant, lobular corners 118 are utilized on a portion of hand gripping portion 102 in combination with corners 104 (FIG. 8). In a preferred embodiment, the number of lobular corners 118 is greater than two as illustrated in FIGS. 6 and 7. Where a "snap on" cap 136 (FIG. 8) is used herein, it is understood that the cap 136 can snap over the lobular corners 118 to enclose compartments 110. A variety of snap on caps are known and can be used with the present invention. The removable cap 136, 138 (having flip top portion 140) (FIGS. 8 and 10) exposes the elongated storage compartments 110 to a user upon actuation of the removable cap.

As illustrated in FIG. 14, cap 120 is rotatably disposed around screw 150 which is fixedly secured to hand gripping portion 102. Screw 150 is partially disposed in recess 152 on cap 120 and retains spring 154. Spring 154 biases cap 120 toward hand gripping portion 120. Cap 120 is moved up away from hand gripping portion 102 and rotated as indicated by line 156 and cap 120 as illustrated in phantom. The cap is then rotated around as indicated by arrow 158 around the axis of screw 15 such that recess 158 is aligned with pin 160. Once recess 158 is aligned with pin 160, cap 120 is allowed to spring back to an unactivated position so that cap 120 encloses storage compartments 110 and prevents bits 116 from exiting the storage compartments 110.

It is understood that hand gripping portion generally has a cross section that takes the shape of a two dimensional geometric shape such as a triangle, square, rectangle, pentagon, hexagon, heptagon, octagon, etc. FIGS. 2 and 3 illustrate hand gripping portion 102 that has a cross section of a triangle and in which the number of corners 104 equals three. FIGS. 1, 4, 5, and 11 illustrate a hand gripping portion 102 that has a cross section of a square and in which the number of corners equals 4.

Hand gripping portion 102 comprises a plurality of bits 116 (FIGS. 1 and 11). The exploded view of FIG. 1 illustrates bits 116 disposed outside of hand gripping portion 102. Generally, bits 116 are stored inside hand gripping portion 102 as illustrated in FIG. 11 in storage compartments 110. Hand gripping portion 102 also comprises main storage cavity 122 which has an axis parallel to imaginary line 106. Main storage cavity 122 is generally cylindrical in shape and extends from proximal end 124 (FIG. 11) of the hand gripping portion 102 to the distal open end 126 (FIGS. 11 and 12) of hand gripping portion 102. Storage compartments 110 generally are formed in a portion of hand gripping portion 110 and are of a size and shape to retain bits 116 which are inserted into the storage compartments at end 124 and which hit a limit stop disposed within the interior of the hand gripping portion 102 and storage compartments 110 so that the bits 116 do not exit end 126 and interfere with the operation of the device when bits 116 are stored in compartments 110.

Hand tool 100 includes means for interchangeably utilizing bits 116 with hand gripping portion 102. The means for interchangeably utilizing bits 116 with hand gripping portion generally includes a single or multiple coupling members 128. Coupling member 128 includes a pair of ears 130 and ball detent 132 which reversibly, and removably retain coupling member 128 in hand gripping portion 102. In particular, ears 130 engage recesses 134 (FIGS. 12 and 13). Many forms of removably and reversibly engaging coupling member 128 are used with the invention, and the embodiment described herein is only illustrative of these means which provide further storage capacity for hand tool 100. Further, coupling member 128 includes a single coupling of a plurality of mateable couplings each of which hold bits 116 and telescope one within another. By way of example where there are two smaller couplings (not shown) which each removably and reversibly retain two bits per coupling, hand tool 100 includes 14 different tools (8 bits having two driver portions each) are retained in the smaller couplings which telescope into a larger coupling member which is reversibly retained in hand gripping portion 102. Of course it is understood that there can be a plurality of telescoping coupling members also used herein. Central cavity 122 is of a size and shape to accommodate a single coupling member 128 containing bits 116, or multiple telescoping coupling members storing bits therein.

The embodiment in FIG. 1 stores five bits 116 in the tool 100. Bits 116 are generally bits having at least two male or female driving portions thereon. Hence, as is appreciated the tool of FIG. 1 includes 10 different tools. Generally, the total number of bits stored in hand gripping portion 102 is equal to N multiplied by the number of elongated storage compartments 110 where N is an integer greater than one. In a variant, storage compartments 110 are of a depth and length within hand gripping portion 102 to accommodate two or more bits 116 stacked one on top of another. In this embodiment, the length of hand gripping portion 102 is longer than that illustrated in FIG. 1, and the total number of bits stored in the hand gripping portion 102 is equal to two multiplied by the number of elongated storage compartments 110. In yet other variants, where bits 116 are stacked one on top of another in respective storage compartments 110 (assuming there are four storage compartments) and two bits 116 in coupling member 128, a total of twenty different funtion tools result therefrom.

In yet another variant, hand tool 100 having a storage compartment 110 for storing multiple bits 116 includes a non-cylindrical, elongated, hand gripping portion 102 having a plurality of corner apexes 104 from which adjacent side walls 136 (FIGS. 1 and 15) extend. Adjacent side walls 136 are generally planar as illustrated in FIGS. 1–5, 11 and 15) but may also be ribbed. The adjacent side walls 136 have an exterior surface, and elongated storage compartments 110 disposed in juxtaposition to the corner apexes 104, 118. Means for interchangeably removing multiple male bit drivers 116 or female bit drivers (not illustrated) from the hand gripping portion 102 are provided.

Hand tool 100 is a screw driver in one variant. In yet another variant, hand tool 100 is a nut driver comprising a plurality of bits 116 disposed within said elongated storage compartments. Generally, the total number of bits 116 stored in hand gripping portion 102 is equal to N multiplied by the number of elongated storage compartments 110 where N is an integer greater than one, or is equal to two multiplied by the number of elongated storage compartments 110.

In yet a further variant, hand tool 100 includes an epicycloidally shaped, elongated, hand gripping portion 102. Hand gripping portion 102 has a plurality of epicycloids 140 (FIGS. 6–7), and at least one elongated storage compartment 110 extending into a respective epicycloidal portion 140. In general, epicycloidal portion 140 includes a cross section having a curve traced by a point on the circumference of a circle that rolls around the outside of a fixed circle. Of course the circle can have radii of varying lengths as appropriate for the use of hand tool 100. In this variant, the elongated storage compartment 110 have wall portions 142 thereof being formed from portions of respective epicycloidal portions 140. The hand gripping portion 102 further includes central coupling retaining cavity 144 (FIG. 7) encircled by the elongated storage compartments 110. Wall portions 142 optionally are of uniform or substantially uniform thickness around the periphery of hand gripping portion 102 allowing for the number of bits 116 stored within said multiple bit storing hand tool 100 to be maximized while the elongated hand gripping portion 102 of tool 100 is minimized in bulk material volume and weight as compared to a tool having a cylindrical hand gripping portion.

Optionally, at least two adjacent epicycloidal portions 140 of hand gripping portion 102 have valley 146 therebetween (FIG. 7). The present invention also includes a tool kit or set that includes, in combination, a plurality of interchangeable male bits 116 or female bits (not shown), a coupling member 128, and/or hand gripping portion 102. Each respective bit 116 has dual male bit driving portions 144 (FIG. 1), and a portion of which is substantially congruent to bit retaining pocket 148 (which may be hexagonal in cross section). Preferably, each of male bits 116 have different sized male engaging portions 144 that extend beyond the bit retaining pocket 148 and are compatible with a fastener, a socket tool to which torque is applied, or a bolt (not shown). In yet another variant, different sized male engaging portions of male bits 116 extend beyond bit retaining pocket 148 and are substantially rectangular in shape and accommodate both metric and SAE size sockets having a width selected from the group of widths in the range of about 0.05 inches to about 1 inch. In yet a further variant, different sized male engaging portions extend beyond the bit retaining pocket 148 that are substantially in the shape of Torx® bits having decreasing diameters. This allows for the tool kit to universally accommodate a wide variety of sockets, fasteners and bolts. It is appreciated that the manipulation of a wide variety of different sized screws or bolts located in hard to reach places is greatly facilitated through the use of a single tool of the present invention. It is further appreciated that male engaging portions 144 of male bits 116 can be of any geometric size or shape to accommodate slots in various types of fasteners, bolts and the like. These include, by way of example, Phillips types of blades, flat and triangular types of blades, and the like.

In yet a further variant, the means for interchangeably retaining a desired male bit 116 in coupling member 128 also includes a ball bearing 148 (FIG. 1) made of a suitable material such as steel or plastic. Bearing or projection 148 is resident in an aperture disposed on bit 116 (not shown), and is biased toward said coupling member 128 by a spring (not shown).

Figure 16:
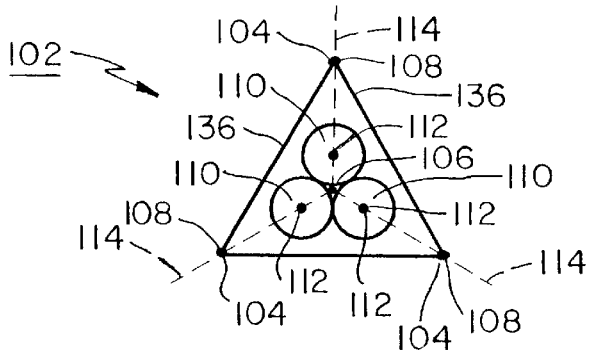
FIG. 16 is a top plan view of a variant of a triangular hand gripping portion for a precision hand tool with the storage compartments being tangent one to another and free of a center cavity.
Figure 17:
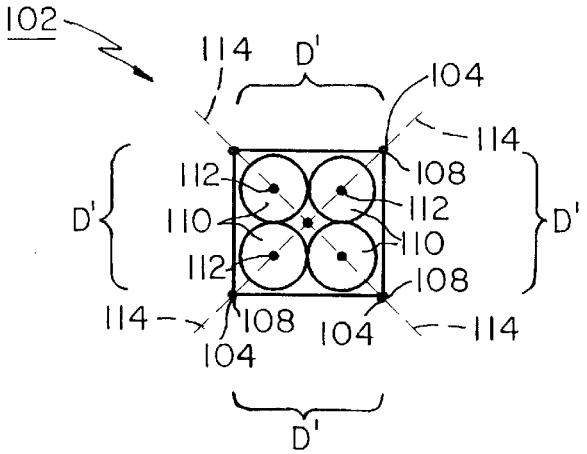
FIG. 17 is a top plan view of a variant of a square hand gripping portion for a precision hand tool with the storage compartments being tangent one to another and free of a center cavity; and, FIG. 18 is a top plan view of a variant of a rhomboidally shaped hand gripping portion with the storage compartments being tangent one to another.
Figure 18:
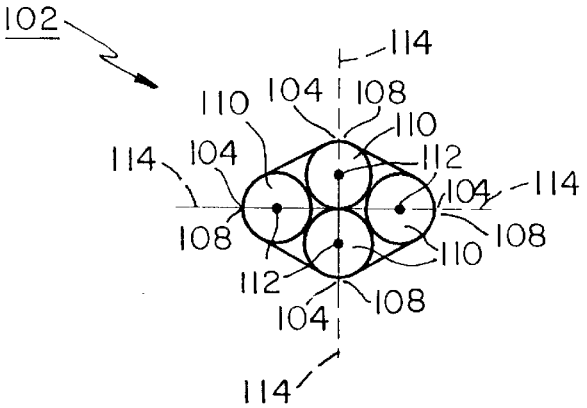

FIGS. 16 and 17 illustrate top plan views of a variant of a triangular and rectangular and/or square hand gripping portion 102 for a precision hand tool 100 in which the storage compartments 100 are tangent one to another and free of a center cavity 122. FIG. 18 is a top plan view of a rhomboidally shaped hand gripping portion 102 with storage compartments 110 being tangent one to another or positioned to one another so as to minimize the total cross sectional area of the hand gripping portion. It is appreciated that where very small hand gripping portions 102 are desired as in the case of precision hand tools such as screw and nut drivers and the like (e.g. for use in applications involving computer hardware, electronics, jewelry and the like), center cavity 122 can be eliminated without departing from the spirity of scope of the invention.

The precision hand tool 100 has storage compartments 100 for storing multiple bits and has a non-cylindrical, elongated, hand gripping portion 102 having a plurality of corner apexes 104 from which adjacent side walls 136 extend. The adjacent side walls 136 have an exterior surface, and elongated storage compartments 110 disposed in juxtaposition to the corner apexes 104 and positioned one to another to create the smallest possible total cross-sectional area of the hand gripping portion 102 in the same plane as imaginary lines 114. In one variant the elongated storage compartments are tangent one to another or with respect to each successive storage compartment. The cross-sectional area (D' times D') and volume (D' times D' times the length of hand gripping portion 102) of hand gripping portion 102 is minimized in comparison to conventional cylindrical exterior handles.

In yet another variant, hand tool 100 having a storage compartment 110 for storing multiple bits 116 includes a non-cylindrical, elongated, hand gripping portion 102 having a plurality of corner apexes 104 from which adjacent side walls 136 (FIGS. 1 and 15) extend. Adjacent side walls 136 are generally planar as illustrated in FIGS. 1–5, 11 and 15 but may also be ribbed. The adjacent side walls 136 have an exterior surface, and elongated storage compartments 110 disposed in juxtaposition to the corner apexes 104, 118. Means for interchangeably removing multiple male bit drivers 116 or female bit drivers (not illustrated) from the hand gripping portion 102 are provided.

The coupling member 128 and the male bits 116 of the present invention have a hardness range of from about 53 to about 57 Rockwell C scale, and are made from an alloy steel having properties of desired strength and toughness, as well as requisite flexibility. A more preferred hardness range, on the other hand, is from about 54 to about 55 Rockwell C scale, using an oil-hardening alloy spring steel having relatively higher amounts of silicon and manganese than other plain carbon tools or alloy tool steels. Hand gripping portion is generally constructed from a plastic, metal, wood or other suitable material.

While only a few, preferred embodiments of the invention have been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. In an improved multiple bit storing hand tool having a handle having a hand gripping portion for storing tool bits, the improvement comprising:

said hand gripping portion being non-cylindrical and elongated, and having corners and a central axis substantially parallel to a plurality of substantially parallel corner axes of said corners, each of said substantially parallel corner axes being substantially equidistant from said central axis and substantially equidistant one from another, a plurality of elongated storage compartments in said hand gripping portion each having a compartment axis substantially parallel to said parallel corner axes and said central axis, said elongated storage compartments being contiguous, and said compartment axis of each of said elongated storage compartments crossing an imaginary line connecting said central axis with each of said parallel corner axes, with each said storage compartment adjacent a respective corner axis;

whereby the number of bits stored within said elongated storage compartments of said multiple bit storing hand tool handle is maximized while said elongated hand gripping portion is minimized in bulk volume, cross-sectional area, and weight as compared to a conventional hand tool handle.

2. The improved multiple bit storing hand tool of claim 1, in which said corners are lobular corners.

3. The improved multiple bit storing hand tool of claim 2, in which the number of said lobular corners is greater than two.

4. The improved multiple bit storing hand tool of claim 1, in which the number of said corners equals three.

5. The improved multiple bit storing hand tool of claim 1, in which elongated storage compartments total the sum of the corners less one.

6. The improved multiple bit storing hand tool of claim 1, in which the number of said corners equals four.

7. The improved multiple bit storing hand tool of claim 1, in which the number of said corners is greater than four.

8. The improved multiple bit storing hand tool of claim 1, in which the length of said elongated hand gripping portion is at least the length of the average hand grip of an adult male.

9. The improved multiple bit storing hand tool of claim 1, further comprising a plurality of bits and means for interchangeably utilizing said bits with said hand gripping portion.

10. The improved multiple bit storing hand tool of claim 9, in which the total number of bits stored in said hand gripping portion is equal to N multiplied by the number of elongated storage compartments where N is an integer greater than one.

11. The improved multiple bit storing hand tool of claim 1, in which the total number of bits stored in said hand gripping portion is equal to two multiplied by the number of elongated storage compartments.

12. The improved multiple bit storing hand tool of claim 1, further comprising a removable cap exposing said elongated storage compartments upon actuation of said removable cap.

13. The improved multiple bit storing hand tool of claim 1, further comprising a central elongated storage compartment, said central axis comprising the axis of said central elongated storage compartment, said central elongated storage compartment being contiguous with each other elongated storage compartment of said plurality of elongated storage compartments.

14. In an improved multiple bit storing hand tool having a handle having a hand gripping portion for storing tool bits, the improvement comprising:

said hand gripping portion being non-cylindrical and elongated, and having adjacent side walls and corners, and a central axis substantially parallel to a plurality of substantially parallel corner axes of said corners, each of said substantially parallel corner axes being substantially equidistant from said central axis and substantially equidistant one from another, a plurality of elongated storage compartments in said hand gripping portion each having a compartment axis substantially parallel to said parallel corner axes and said central axis, means for communicating said elongated storage compartments so that said compartments are contiguous, and said compartment axis of each of said elongated storage compartments crossing an imaginary line connecting said central axis with each of said parallel corner axes, with each said storage compartment adjacent a respective corner axis;

whereby the number of bits stored within said elongated storage compartments of said multiple bit storing hand tool handle is maximized while said elongated hand gripping portion is minimized in bulk volume, cross-sectional area, and weight as compared to a conventional hand tool handle.

15. The hand tool of claim 14 in which said adjacent side walls are generally planar.

16. The hand tool of claim 14 in which said adjacent side walls are ribbed.

17. The hand tool of claim 14 in which said elongated storage compartments total the sum of the corner apexes less one.

18. The hand tool of claim 14 which is a screw and/or nut driver.

19. The hand tool of claim 14 in which each of said elongated storage compartment is a bore.

20. The hand tool of claim 14, further comprising a plurality of bits disposed within said elongated storage compartments.

21. The hand tool of claim 14, in which the total number of bits stored in said hand gripping portion is equal to N multiplied by the number of elongated storage compartments where N is an integer greater than one.

22. The hand tool of claim 14, in which the total number of bits stored in said hand gripping portion is equal to two multiplied by the number of elongated storage compartments.

23. The hand tool of claim 14, further comprising a removable cap exposing said elongated storage compartments upon actuation of said removable cap.

24. In an improved multiple bit storing hand tool having a handle having a hand gripping portion for storing tool bits, the improvement comprising:

said hand gripping portion being non-cylindrical and elongated, and having side walls and corners, and a central axis substantially parallel to a plurality of substantially parallel corner axes of said corners, each of said substantially parallel corner axes being substantially equidistant from said central axis and substantially equidistant one from another, a plurality of elongated storage compartments in said hand gripping portion each having a compartment axis substantially parallel to said parallel corner axes and said central axis, and said compartment axis of each of said elongated storage compartments crossing an imaginary line connecting said central axis with each of said parallel corner axes, with each said storage compartment adjacent a respective corner axis;

further comprising a central elongated storage compartment, said central axis comprising the axis of said central elongated storage compartment, and said central elongated storage compartment being contiguous with each other elongated storage compartment of said plurality of elongated storage compartments.

25. The hand tool of claim 24, further comprising a plurality of bits disposed within said elongated storage compartments.

26. The hand tool of claim 24, in which the total number of bits stored in said hand gripping portion is equal to N multiplied by the number of elongated storage compartments where N is an integer greater than one.

27. The hand tool of claim 24, in which the total number of bits stored in said hand gripping portion is equal to two multiplied by the number of elongated storage compartments.

28. The hand tool of claim 24, further comprising a removable cap exposing said elongated storage compartments upon actuation of said removable cap.

* * * * *